United States Patent [19]

Takeuchi et al.

[11] 4,320,276

[45] Mar. 16, 1982

[54] DIELECTRIC HEATING DEVICE

[75] Inventors: Takashi Takeuchi, Fujisawa; Yoichi Kaneko, Tokorozawa; Hisato Owatari, Kyoto, all of Japan

[73] Assignee: Hitachi, Ltd., Tokyo, Japan

[21] Appl. No.: 115,409

[22] Filed: Jan. 25, 1980

[30] Foreign Application Priority Data

Jan. 26, 1979 [JP] Japan ..... 54-7139

[51] Int. Cl.[3] ..... H05B 9/04

[52] U.S. Cl. ..... 219/10.81; 99/358; 426/244

[58] Field of Search ..... 219/10.41, 10.55 M, 219/10.61, 10.79, 10.81, 383, 384, 432; 62/80, 89; 99/358; 257/291; 427/21, 1.95; 426/107, 234, 237, 242, 244; 156/273

[56] References Cited

U.S. PATENT DOCUMENTS

| | | | |
|---|---|---|---|
| 2,253,971 | 8/1941 | Dodge | 219/385 X |
| 3,043,569 | 7/1962 | Arwentrout | 219/432 |
| 3,053,960 | 9/1962 | Spielas | 219/10.55 |
| 3,330,932 | 7/1967 | Gros | 219/10.61 |
| 3,394,007 | 7/1968 | Campbell | 219/10.81 X |
| 3,943,332 | 3/1976 | Marsh | 99/358 X |
| 4,112,285 | 9/1978 | Pau et al. | 219/10.41 |
| 4,119,826 | 10/1978 | Chambley et al. | 219/10.81 |

FOREIGN PATENT DOCUMENTS 51-95064 1/1976 Japan .

*Primary Examiner*—Volodymyr Y. Mayewsky
*Attorney, Agent, or Firm*—Craig and Antonelli

[57] ABSTRACT

A dielectric heating device for heating a dielectric sandwiched between a pair of electrodes is disclosed in which an oscillation circuit is made up of the above-mentioned electrodes, a coil connected in series with the electrodes, a first capacitor connected in parallel with a series circuit made up of the electrodes and the coil, another series circuit connected in parallel with the first capacitor and made up of second and third capacitors and a field effect transistor having source and drain electrodes connected respectively to one and the other electrodes of the second capacitor and a gate electrode connected to a junction point for connecting the first and third capacitors.

15 Claims, 2 Drawing Figures

DIELECTRIC HEATING DEVICE

BACKGROUND OF THE INVENTION

1. Field of the Invention

The present invention relates to a dielectric heating device for thawing frozen goods by dielectric heating.

2. Description of the Prior Art

A Japanese utility model application Ser. No. 14125/75 (Utility Model Laid-open No. 95064/76) discloses a refrigerator provided with a thawing chamber, in which such frozen goods as frozen food are disposed between a pair of electrodes of a capacitor applied with a high-frequency voltage. The above capacitor and a coil make up a series resonance circuit which is used as the load of a power amplifier, and therefore the frozen goods serving as the dielectric of the capacitor can obtain a sufficient supply of high-frequency power. However, the electric impedance (namely, capacitance and inductance) of the capacitor, which contains between the electrodes thereof the frozen goods, varies with such factors as the shape and kind of the frozen goods and the thawing temperature, and therefore the resonance frequency of the resonance circuit is also varied. In order to effectively supply the frozen goods with high-frequency power, the oscillation frequency of a high-frequency power supply has to be made equal to the resonance frequency of the resonance circuit. In order to satisfy this requirement, there has been proposed a circuit, in which a variable capacitor is connected in parallel with the above capacitor, a variation in the resonance frequency of the resonance circuit including the variable capacitor is detected, and the capacitance of the variable capacitor is automatically controlled so as to suppress the detected variation. However, since an automatic control system is indispensable, the above circuit is complicated in circuit construction and is expensive.

SUMMARY OF THE INVENTION

An object of the present invention is to provide a dielectric heating device which does not include any automatic control device for adjusting the oscillation frequency, but oscillates in accordance with a variation in electric impedance of a capacitor to effectively obtain the dielectric loss in the dielectric of the capacitor.

In order to attain the above and other objects, according to the present invention, a coil is connected in series with a capacitor containing frozen goods between its electrodes to form a series circuit, which is used as at least a part of elements for determining the oscillation frequency of an oscillator. Since the capacitor is one of the elements for determining the oscillation frequency, the oscillation frequency varies with the electric impedance of the capacitor which depends upon the initial state of the frozen goods and the thawing process, and therefore the series circuit is always supplied with a sufficient amount of resonance energy.

DESCRIPTION OF THE PREFERRED EMBODIMENT

Figure 1:
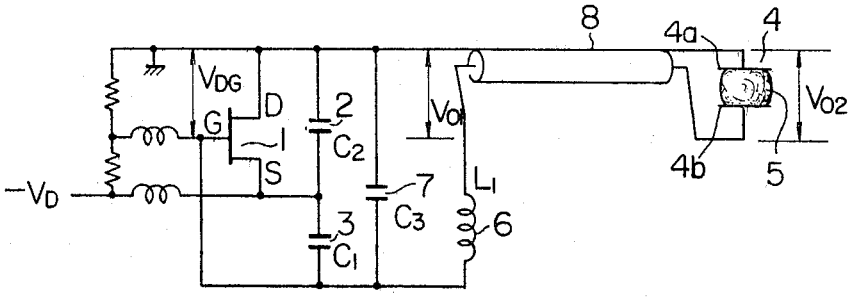
FIG. 1 is a circuit diagram showing an embodiment of a dielectric heating device according to the present invention.

Now, explanation will be made on an embodiment of the present invention with reference to FIG. 1. In FIG. 1, reference numeral 1 designates an N-channel field effect transistor acting as an active element of an oscillator, 2 and 3 designate capacitors for feeding back a part of the voltage developed between the gate and the drain of the field effect transistor 1 as a voltage applied between the gate and the source, 4 designates a capacitor for accommodating between the electrodes 4*a* and 4*b* thereof frozen goods 5, 6 designates a coil for forming a series resonance circuit together with the capacitor 4 to determine a resonance frequency, 7 designates a capacitor for enlarging the frequency range in which the oscillator can sustain oscillation in spite of a variation in load, and 8 designates a coaxial cable. These parts make up a clapp oscillator, whose oscillation frequency is mainly determined by the series resonance circuit made up of the capacitor 4 and the coil 6. The coaxial cable 8 is used to connect the capacitor 4 to other parts, since a thawing chamber containing the capacitor 4 is provided within a refrigerator in such a manner as to be spaced apart from other parts. Further, the coaxial cable 8 produces an effect that a voltage on the output side of the cable 8, namely, a voltage applied across the capacitor 4 is made greater than a voltage on the input side of the cable 8 due to the distributed capacitance and inductance of the coaxial cable 8.

The oscillation frequency of the oscillator is mainly determined by the series resonance circuit made up of the capacitor 4 and the coil 6, and therefore varies with the capacitance of the capacitor 4. Further, since the voltage developed across the capacitor 4 is opposite in phase to that developed across the coil 6, the voltage applied between the electrodes 4*a* and 4*b* of the capacitor 4 is several times as high as that applied between the drain and the gate of the field effect transistor 1. Thus, a high voltage can be generated between the electrodes of the capacitor 4 without applying a high voltage to other parts than the capacitor 4 and the coil 6. Further, the frequency range in which the oscillation frequency can vary with the capacitance of the capacitor 4, the voltage generated across the electrodes of the capacitor 4, the oscillation efficiency of the oscillator, and so on can be appropriately determined by selecting the capacitance of each of the capacitors 2, 3 and 7.

The following table shows an example of operation in the embodiment shown in FIG. 1. As is seen from the table, the voltage $V_{02}$ on the output side of the coaxial cable 8 is higher than the voltage $V_{01}$ on the input side, and therefore the frozen goods are supplied with high-frequency power of high voltage. Further, the voltage applied to the field effect transistor 1 is limited to 150 V or less, though a high voltage is generated across the electrodes of the capacitor 4.

TABLE

| Capacitor 4 (PF) | Frequency (MHz) | $V_{01}$ (Vpp) | $V_{02}$ (Vpp) | $V_{DG}$ (Vpp) |
|---|---|---|---|---|
| 20 | 13.7 | 900 | 1100 | 140 |
| 100 | 11.2 | 600 | 700 | 150 |

In the above case, the capacitance $C_1$, $C_2$ and $C_3$ of the capacitors 3, 2 and 7 were equal respectively to 2200, 120 and 560 PF, and the inductance $L_1$ of the coil 6 was equal to 0.6 $\mu$H. Further, a 50-$\Omega$ coaxial cable having a length of 2 m was used as the cable 8, and the negative voltage $-V_D$ was equal to $-55$ V.

Figure 2:
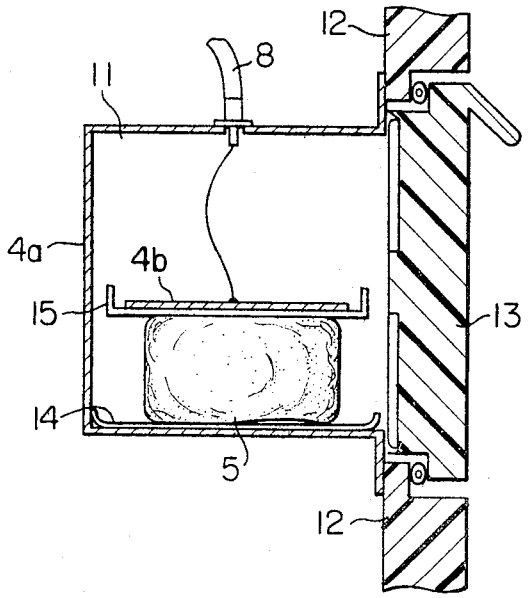
FIG. 2 is a side section view showing an example of a thawing chamber provided within a refrigerator.

FIG. 2 is a side section view for showing an example of a thawing chamber provided in a refrigerator. In FIG. 2, reference numeral 11 designates a thawing chamber mounted on a door 12 of a refrigerator, and 13 designates a door of the thawing chamber for shielding a high frequency wave and for preventing heat conduction. One electrode 4*a* of the capacitor 4 is used as an envelope of the thawing chamber 11, and the other electrode 4*b* can move upward and downward in the thawing chamber. Between the electrode 4*a* and the frozen goods 5 is disposed a saucer 14, which is made of a synthetic resin such as polypropylene and receives any liquid produced from the frozen goods 5 during the thawing period. Further, between the electrode 4*b* and the frozen goods 5 is disposed an insulator 15, which is made of a synthetic resin and prevents the electrode 4*b* from being brought in contact with the frozen goods 5 and a human body.

As has been described hereinbefore, according to the present invention, the oscillation frequency varies with the electric impedance of the capacitor 4 which depends upon the initial state of the frozen goods and the thawing process, and therefore it is possible to effectively supply the frozen goods with high-frequency power.

Further, since a circuit element having a high breakdown voltage is not required and moreover the circuit construction is simple, the dielectric heating device according to the present invention is low in cost and high in reliability. Furthermore, since the capacitor 4 is connected to other parts through the coaxial cable 8, the voltage applied to the capacitor 4 can be made higher than that applied to the input side of the cable 8 without increasing the number of parts used.

We claim:

1. A dielectric heating device comprising:

a series circuit made up of a capacitor and a coil, said capacitor having a pair of electrodes between which frozen goods to be subjected to dielectric heating may be disposed, the capacitance of said capacitor varying in response to the heating of said frozen goods;

an amplifier having an input and an output, said series circuit being connected across said output of said amplifier; and positive feedback means for establishing a positive feedback of a part of the output voltage appearing at said output of said amplifier to said input thereof to allow said amplifier to oscillate, the oscillation frequency of said amplifier depending upon the resonance frequency of said series circuit.

2. A dielectric heating device according to claim 1, comprising a coaxial capable having a distributed capacitance and a distributed inductance forming part of said circuit as a means for effecting connection between said capacitor and said coil.

3. A dielectric heating device according to claim 2, wherein one electrode of said capacitor is formed of at least a part of conductive walls of the a vacant chamber within which said frozen goods are to be placed, and the other electrode of said capacitor is formed of a conductive plate which is placed parallel to a wall forming said one electrode and is movable within said vacant chamber.

4. A dielectric heating device comprising:

a series circuit made up of a first capacitor and a coil, said first capacitor having a pair of electrodes between which frozen goods may be disposed;

an amplifier including a transistor having first, second and third electrodes, said first and second electrodes being connected to one and the other ends of said series circuit, respectively; and positive feedback means for establishing a positive feedback of a part of the voltage appearing between said first and second electrodes to said third electrode.

5. A dielectric heating device according to claim 4, wherein said positive feedback means comprises a second capacitor connected between said first and third electrodes and a third capacitor connected between said second and third electrodes.

6. A dielectric heating device according to claim 5 further comprising a fourth capacitor connected in parallel with said series circuit.

7. A dielectric heating device according to claim 4, 5 or 6, comprising a coaxial cable having a distributed capacitance and a distributed inductance provided between said first capacitor and said coil.

8. A dielectric heating device according to claim 4, 5 or 6, wherein one electrode of said first capacitor is formed of at least a part of the conductive walls of a vacant chamber within which said frozen goods are to be placed, and the other electrode of said first capacitor is formed of a conductive plate which is placed parallel to a wall forming said one electrode of said first capacitor and is movable within said vacant chamber.

9. A dielectric heating device comprising:

(1) a series circuit including a coil and a capacitor having a pair of opposed electrodes between which frozen goods to be thawed may be disposed, the capacitance of said capacitor depending on both the material and the thawing condition of said frozen goods, whereby the resonant frequency of said series circuit depends on both said material and said thawing condition;

(2) an amplifier having a pair of output terminals between which said series circuit is connected and at least one input terminal;

(3) positive feedback means for supplying to said input terminal a portion of a voltage produced across said series circuit to cause said amplifier to operate in an oscillating condition whose oscillating frequency depends on said resonant frequency of said series circuit.

10. A dielectric heating device according to claim 9, further comprising a coaxial cable having a distributed capacitance and a distributed inductance, said coaxial cable including an outer conductor connected between one of said opposed electrodes of said capacitor and one of said output terminals of said amplifier and an inner conductor connected between the other of said opposed electrodes of said capacitor and one end of said coil whose other end is connected to the other of said output terminals.

11. A dielectric heating device according to claim 10, wherein said one of said opposed electrodes of said capacitor is formed of at least a part of conductive walls of a vacant chamber within which said frozen goods are to be placed, and said other of said opposed electrodes of said capacitor is formed of a conductive plate which is placed parallel to a wall forming said one of said opposed electrodes and is movable within said vacant chamber.

12. A dielectric heating device comprising:

a series circuit including a first capacitor and a coil, said first capacitor having a pair of electrodes between which frozen goods may be disposed;

an amplifier including a transistor having input, common, and output electrodes, said input and common electrodes being connected to one and the other ends of said series circuit, respectively;

a voltage dividing means comprising two impedance means connected in series between said output and common electrodes; and positive feedback means for connecting a connection point of said two impedance means to said input electrode.

13. A dielectric heating device according to claim 12, wherein said impedance means comprises a capacitor, respectively.

14. A dielectric heating device according to claim 13, further comprising another capacitor connected in parallel with said series circuit.

15. A dielectric heating device according to claims 12, 13 or 14, comprising a coaxial cable having a distributed capacitance and a distributed inductance, said coaxial cable including an inner conductor connected between one electrode of said capacitor and one end of said coil whose other end is connected to said common electrode and an outer conductor connected between the other electrode of said capacitor and said output electrode.

* * * * *